US005476318A

United States Patent [19]

Yingst et al.

[11] Patent Number: 5,476,318

[45] Date of Patent: Dec. 19, 1995

[54] REGRIGERATOR/FREEZER THERMAL BREAKER AND DOOR HANDLE

[75] Inventors: Thomas E. Yingst; Gerald J. Stensrud, both of Bedford; Ronald S. Davis, Euless, all of Tex.

[73] Assignee: Traulsen & Co. Inc., College Point, N.Y.

[21] Appl. No.: 302,630

[22] Filed: Sep. 8, 1994

[51] Int. Cl.[6] ..... A47B 96/04

[52] U.S. Cl. ..... 312/405; 312/406; 49/462; 49/478.1

[58] Field of Search ..... 312/405, 406, 312/401, 332.1, 348.6, 348.4; 16/124; 49/462, 478.1

[56] References Cited

U.S. PATENT DOCUMENTS

| | | | |
|---|---|---|---|
| 3,359,053 | 12/1967 | Hagendoorn | 312/405 |
| 4,469,383 | 9/1984 | Losert | 312/405 |
| 4,617,759 | 10/1986 | Pasqualini et al. | 312/405 |
| 4,653,819 | 3/1987 | Sweebinsky | 312/405 |
| 4,948,206 | 8/1990 | Fitzpatrick | 312/405 |
| 5,355,554 | 10/1994 | Magoon | 16/124 |
| 5,412,839 | 5/1995 | McCollom | 16/124 |

*Primary Examiner*—Peter M. Cuomo
*Assistant Examiner*—Anthony D. Barfield
*Attorney, Agent, or Firm*—S. C. Yuter

[57] ABSTRACT

A refrigerator cabinet is disclosed comprising a metallic cabinet case having a door opening in the front, a metallic cabinet liner mounted on the inside and thermal insulation separating the cabinet case and liner. A door is hingedly connected to the front of the cabinet case and adapted to swing over the door opening. A plastic cabinet thermal breaker is mounted between the metallic cabinet case and the metallic cabinet liner and frames the opening. A removable metallic breaker cap snaps on and covers the outside of the plastic cabinet thermal breaker except for a front facing portion of the plastic thermal breaker. A plastic door thermal breaker is mounted along the outer edge of the inside of the door and has an outwardly extending compressible portion which is adapted to press against the front portion of the plastic cabinet thermal breaker when the door is closed. The plastic door thermal breaker has a plastic encased magnet adapted to magnetically close the door when in magnetic attraction range of the front of the metallic cabinet case and an angularly extending wiper in contact with the inside of the door. A recessed door handle is along substantially the entire length of the side of the door opposite the hinged side.

22 Claims, 2 Drawing Sheets

REGRIGERATOR/FREEZER THERMAL BREAKER AND DOOR HANDLE

BACKGROUND OF THE INVENTION

1. Field of the Invention

This invention relates to refrigerator/freezer cabinets, and more particularly to an improved thermal breaker and door handle for such cabinets.

2. Description of the Related Art

Thermal breakers are used in a refrigerator/freezer cabinet (hereinafter jointly "refrigerator cabinet") to insulate the cooled inside air of the refrigerator cabinet from the leakage of warm outside ambient air when the cabinet door is closed. While prior art thermal breakers have worked well, a need has developed for a more efficient thermal breaker, especially for restaurant refrigerator cabinets with stainless steel or aluminum interiors.

There is also a need for a thermal breaker which is not easily damaged by metal trays, pots and other objects placed in the refrigerator cabinet.

Refrigerator cabinet doors can be hinged from either side of the cabinet door opening so that they can swing open from the left or from the right side of the door opening. Hinge mounting holes on both sides of the cabinet opening are provided to relocate the hinges. But in previous designs to accommodate both door swing positions, the door handle had to be relocated, or be located in the center of the door and thus be too low for easy door opening.

SUMMARY OF THE INVENTION

An object of the invention is to provide a more efficient thermal breaker for a refrigerator cabinet.

Another object of the invention is to provide a durable thermal breaker which cannot easily be damaged.

A further object of the invention is to provide a handle for a cabinet refrigerator door which facilitates mounting the door on either side of the door opening without relocating the handle.

Briefly, in accordance with the invention, a refrigerator cabinet is provided comprising a metallic cabinet case having a door opening in the front, a metallic cabinet liner mounted on the inside and thermal insulation separating the cabinet case and liner. A door is hingedly connected to the front of the cabinet case and adapted to swing over the door opening. A plastic cabinet thermal breaker is mounted between the metallic cabinet case and the metallic cabinet liner and frames the opening. A metallic breaker cap is mounted on and covers the outside of the plastic cabinet thermal breaker except for a front facing portion of the plastic thermal breaker. A plastic door thermal breaker is mounted along the outer edge of the inside of the door and has an outwardly extending compressible portion which is adapted to press against the front portion of the plastic cabinet thermal breaker when the door is closed. The plastic door thermal breaker has a plastic encased magnet adapted to magnetically close the door when in magnetic attraction range of the front of the metallic cabinet case.

Thus there is no metal thermal conducting path between the metallic cabinet liner and the metallic cabinet case when the door is closed.

A feature of the invention is that the plastic door thermal breaker has an angularly extending wiper in contact with the inside of the door.

Thus three thermal breaker seals are provided by the invention when the door is closed: the front facing portion of the plastic cabinet thermal breaker and contacting compressible portion of the plastic door thermal breaker; the plastic enclosed magnet magnetically attached to the front of the cabinet, and the plastic wiper in contact with the inside of the door.

An advantage of the plastic wiper is that moisture cannot get between the plastic door thermal breaker and the inside of the door to form undesirable ice pockets.

Another feature of the invention is that the metallic breaker cap is adapted to removably snap on to the plastic cabinet thermal breaker. Thus the breaker cap can readily be replaced if damaged.

A major feature of the invention is a recessed door handle along substantially the entire length of the side of the door opposite the hinged side. Thus the door can be rehinged on either side of the door opening after rotating it 180° without relocating the handle.

An advantage of the recessed door handle is that the refrigerator cabinet can be moved through narrow aisles, especially in restaurants.

Another advantage of the recessed door handle is that it does not protrude from the outside door surface so it cannot catch on people's clothes or objects they are carrying, or be damaged by passing carts.

Other objects, features and advantages of the invention and its features will be apparent from the following detailed description of the preferred embodiment of the invention taken together with the accompanying drawings.

BRIEF DESCRIPTION OF THE DRAWINGS

FIG. 3A is a cross-sectional view taken through the center front of the refrigerator cabinet shown in FIG. 1 showing the plastic cabinet thermal breakers along the door openings before the-metallic breaker caps are snapped on.

In the various figures of the drawings like reference characters designate like parts.

DESCRIPTION OF THE PREFERRED EMBODIMENT

Figure 1:
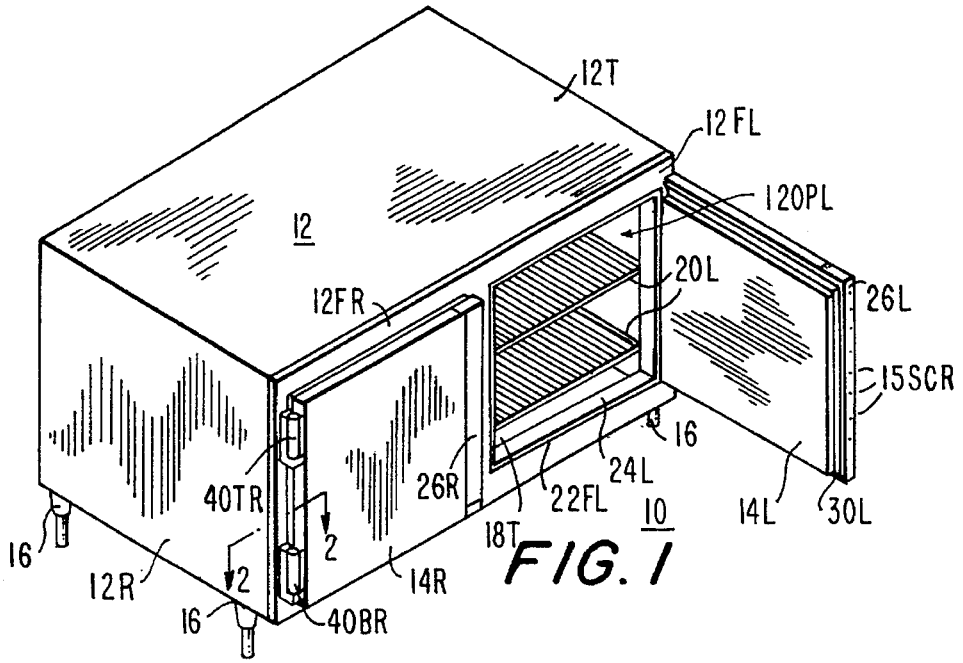
FIG. 1 is an isometric view of a refrigerator cabinet, in accordance with the preferred embodiment of the invention, showing the metallic cabinet case and doors, with the right door open to show the plastic cabinet thermal breaker and metallic breaker cap framing the door opening, and the plastic door thermal breaker correspondingly framing the inside the door.

Referring to FIG. 1 of the drawing, there is shown a refrigerator cabinet 10 having a metallic cabinet case 12, doors 14R and 14L on the right and left sides of the front of the cabinet case 12 and legs 16 which support the refrigerator cabinet 10.

Refrigerator cabinet 10 is refrigerated by a separately encased refrigerating mechanism (not shown) attached to the left side of the refrigerator cabinet 12. Cooled air passes through matching discharge openings in the refrigerating mechanism and refrigerator cabinet 12 and warm air returns through matching return openings. A suitable refrigerating mechanism is described in the copending application of the inventors entitled Reversible Refrigerator/Freezer System filed Sep. 8, 1994.

Door 14L is open showing a metallic cabinet liner or interior tank 18T, shelves 20L slidably mounted in the interior tank 118T, a front facing portion 22FL of a plastic cabinet thermal breaker 22L framing the inside of the door opening 12OPL of the cabinet case 12 and a metallic breaker cap 24L which is snap mounted on the cabinet breaker 22L and also frames the door opening 12OPL. Metallic recessed door handles 26R and 26L are mounted along the entire edges opposite the hinged sides of doors 14R and 14L respectively.

A plastic door thermal breaker 30L is mounted along the outside edge of the inside of door 14L in a position corresponding to or matching the cabinet thermal breaker 22L. That is, when the door 14L is closed the door thermal breaker 30L presses against the front facing portion 22FL of the cabinet thermal breaker 22L (not visible) and the front facing portion of the metallic breaker cap 24L.

The right side of the refrigerator cabinet 10 and its door 14R correspond in construction to its left side.

Figure 2:
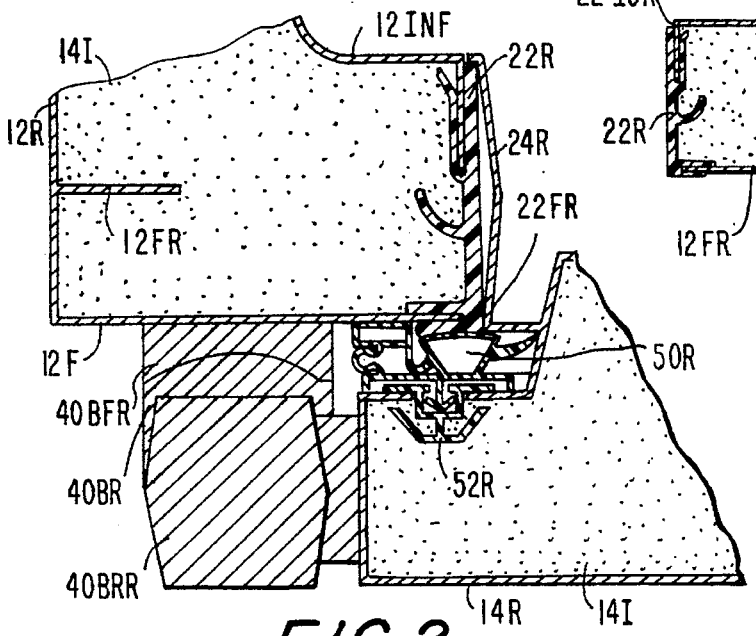
FIG. 2 is a cross-sectional view taken along the line 2—2 in FIG. 1 showing the plastic cabinet thermal breaker and metallic breaker cap which frame the door opening and the corresponding plastic door thermal breaker.

More particularly, as shown in FIG. 2, door 14R is mounted on the front panel 22F of the refrigerator case 22 by top and bottom hinges 40TR and 40BR (FIGS. 1 and 2). Corresponding hinges (not shown) mount door 14L to the front panel 12F. Front panel 12F is connected to the right side panel 12R by the inwardly extending edges 12FR which are riveted together.

Front wall 12FWR (FIG. 3) of cabinet case 12 consists of the front panel 12F and the interior panel 12INF which forms a cavity into which insulating foam 14I is blown.

The interior panel 12INF of the cabinet case 12 is one of five sides of the metallic interior tank 18T with its open end facing the door opening 12OPL (FIG. 1) and the corresponding door opening on the right side of cabinet case 12. The metallic interior tank 18T is dropped into the cabinet case 12 when the cabinet's removable top 12T is removed. The inside metallic panel of removable top 12T is the top of metallic interior tank 18T.

The interior panel 12INF (FIG. 2) makes a quarter-inch radius turn into the right interior panel of the metallic interior tank 18T which extends to the rear of the inside of the cabinet case 12, then makes another quarter-inch radius turn to form the back interior panel along the full inside length of the cabinet case 12, then makes another quarter-inch radius turn to form the left interior panel along the left inside of the cabinet case 12, in the shape of a U. Top and bottom interior panels are connected by front-extending horizontal rails (not shown) along the top edges and lower edges of the U-shaped portion to form the metallic interior tank 18T.

Cabinet thermal breaker 22R (FIG. 3) comprises an inside groove 22IGR formed by a thermal breaker base 22BSR and an opposing finger 22OFR, a front groove 22FGR formed by a front thumb 22FR and front forefinger 22FFR, and a hook 22HKR.

Cabinet thermal breaker 22R, in the shape of a four-sided picture frame, is first mounted on an outside edge of front panel 12FR along the door opening by forcing its front groove 22FGR over the outside edge of front panel 12FR along the outer three sides of the right door opening, which is behind the door 14R (FIG. 1). Then the metallic interior tank 18T is dropped into the cabinet case 12. Then the inside groove 12IGR (FIG. 3) of the cabinet thermal breaker 22R is forced over the outer edges of the metallic interior tank 18T to mount three sides of the cabinet thermal breaker 22R.

Figure 3A:
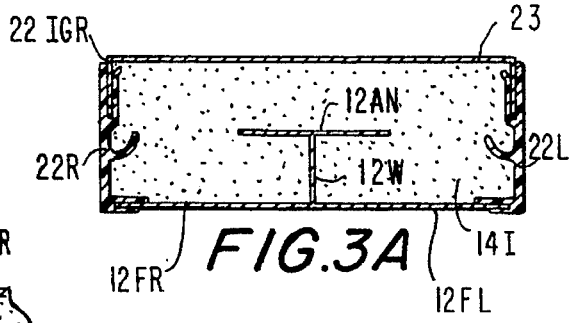

The fourth and inside vertical side of the cabinet thermal breaker 22R is mounted on a vertical pan-shaped mullion 23 (FIG. 3A) attached between the front extending horizontal rails (not shown) at the top and bottom front edges of the metallic interior tank 18T just inside the center front of the cabinet case 12, where the front left panel 12L and extending foam anchor 12AN and front right panel 12R are welded together at 12W. The groove 22IGR is forced over the mullion 23 edge to complete the mounting of the cabinet thermal breaker 22R.

Figure 3:
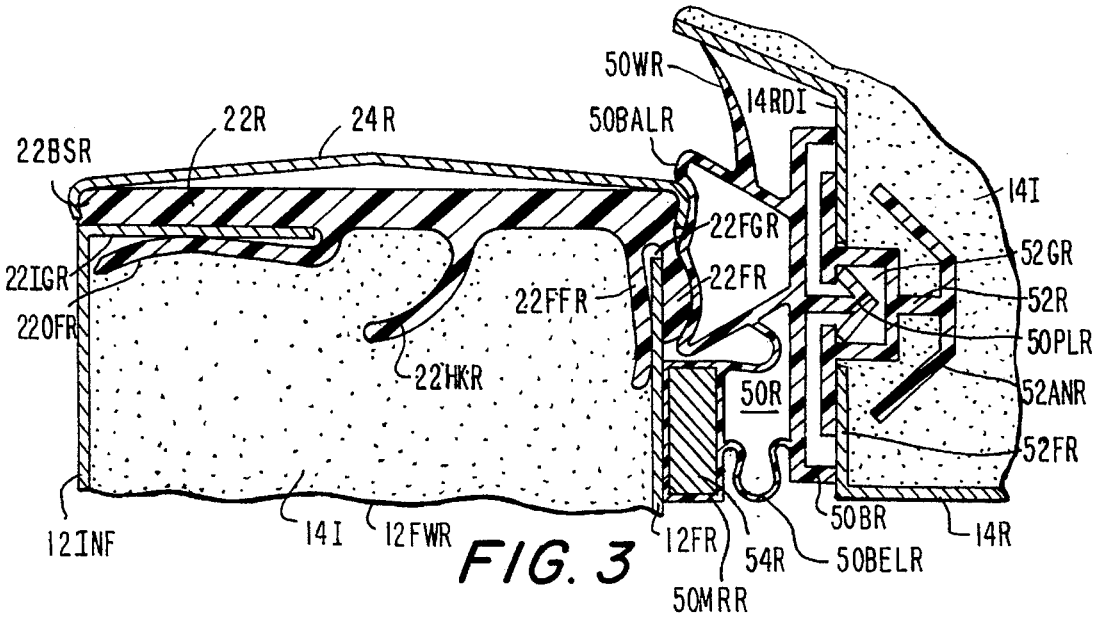
FIG. 3 is an enlarged portion of FIG. 2 showing the plastic cabinet thermal breaker and metallic breaker cap, the compressible part of the plastic door thermal breaker pressing against the front facing plastic part of the cabinet thermal breaker, the plastic encased magnet magnetically attached to the front of the cabinet case and the door thermal breaker plastic wiper angularly pressing against the inside of the door.

Cabinet thermal breaker 22L is mounted on the outer edges of metallic interior tank 18T and mullion 23 the same way. As shown in FIGS. 2 and 3, metallic breaker cap 24R comprises a body substantially equal in width to the width of thermal breaker 22R, with a resilient finger section extending inwardly and substantially orthogonally from each side of the body. The resilient finger section are adapted to removably snap on to the thermal breaker 22R.

Thereafter, the cavities between the right metallic interior tank 18T and the inside of the cabinet case 12 are insulated by a thermally insulating two-part foam 42I which is blown into the cavities.

The door 14R (FIGS. 1, 3 and 5) has a reduced thickness portion 14RDI along the inside of its outer periphery on which a plastic door thermal breaker 5OR in the shape of a rectangular gasket is mounted to correspond in position with the cabinet thermal breaker 22R (FIG. 3) when the door 14R is closed.

Plastic door thermal breaker 50R is made of a flexible plastic and comprises the base 50BR, a balloon 50BALR connected to the outside of base 50BR, a wiper 50WR connected to the one side of the balloon 50BALR, a bellows 50BELR having one side connected to the base 50BR, and a magnet retainer 50MRR connected between the other side of the balloon 50BALR and the other side of the bellows 50BELR. An arrow-head shaped plug 50PLR projects from the inside of base 50BR.

A rigid door breaker retainer 52R is mounted in door 14R to provide a groove 52GR into which the flexible plug 50PLR of door thermal breaker 50R can be inserted. Door breaker retainer 52R comprises an external flange 52FR, the groove 52GR which plugs into a matching opening on the reduced portion 14RDI of the door 14R, and an anchor 52ANR inside the cavity of the door 14R connected to the groove 52G. The door cavity is thereafter foamed by the two-part thermal insulating foam 14I to mount the door breaker retainer 52R in the door 14R via its anchor 52ANR.

Plastic door thermal breaker 50R is mounted on the inside periphery of door 14R by inserting its plug 50PLR into groove 52GR. The outside ends of the arrow-headed plug 52PLE engage the inner corners of the groove 52GR to mount the door thermal breaker 50R tightly in groove 52GR.

Figure 5:
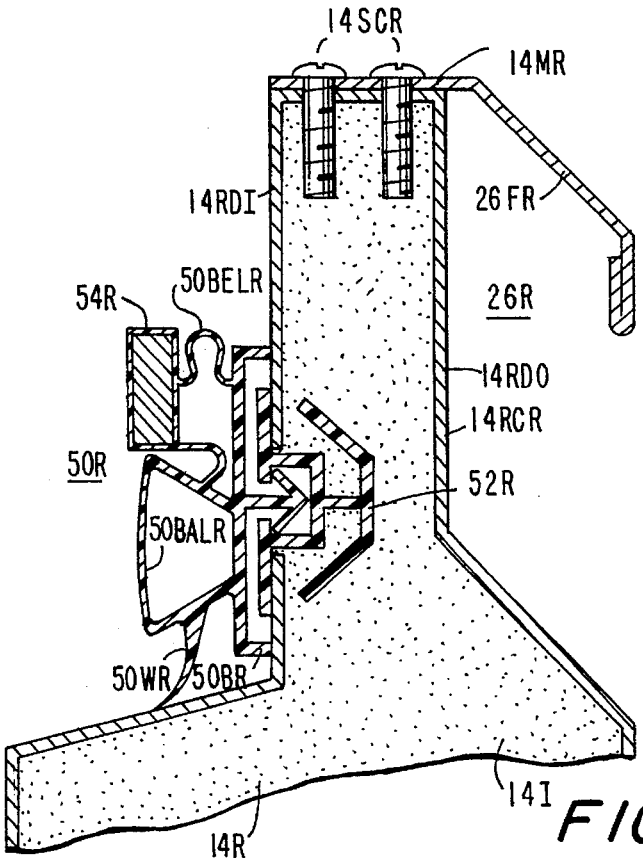
FIG. 5 is a cross-sectional view of the recessed handle on the outside of the door and the plastic door thermal breaker along the outside edge of the inside of the door, with its flexible wiper pressing against the inside of the door.

When the door thermal breaker 50R is mounted its wiper 50WR is pressed against the sloping transition from the inside panel of door 14R to the reduced portion 14RDI (as best shown in FIG. 5) to provide a seal which prevents any spilled liquid from getting behind door thermal breaker 50R to form an undesirable air pocket which can cause ice.

More importantly, when door 14R is closed (FIG. 1), the balloon 50BALR (FIG. 3) presses against the outer edge of metallic breaker cap 24R and the outer edge of the exposed thumb 22FR of the cabinet thermal breaker 22R to form a primary thermal seal.

Magnet 54R is contained in magnet retainer 50MR of cabinet thermal breaker 50R. While thermal breaker 50R and thus magnet retainer 50MR form a continuous rectangle around the right cabinet door opening (the four sides of cabinet thermal breaker 50R are plastic welded together), the magnet 54R is in four separate sections along each of the four sides of the cabinet thermal breaker 50R.

As the door 14R is closed and magnet 54R gets into magnetic attraction range of the metallic front panel 12FR (FIGS. 1 and 3) the door is magnetically pulled shut around the right door opening of the cabinet 12 to form a second thermal seal.

The wiper 50WR forms a third thermal seal, as well as blocking moisture from getting between the plastic cabinet thermal breaker 50R and the metallic inside of door 14R.

Figure 4:
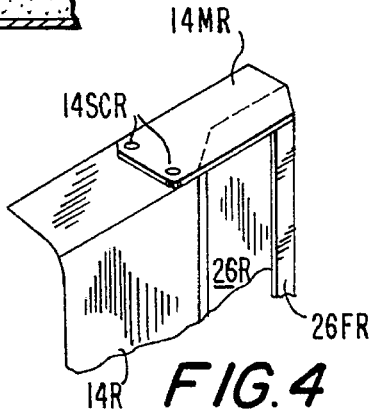
FIG. 4 is an isometric view of the top corner portion of the left door showing the top part of the recessed door handle.

The recessed door handle 26R (FIGS. 3–5) is mounted in a reduced outside portion 14RDO of the door 14R along the entire length of the unhinged side of the door 14R. Recessed door handle 26R consists of a finger grip 26FR, an inner recess 14RCR and a 90°-bent mounting strip 14MR at each of its outer ends. Each of the two mounting strips 14MR is screwed into the outside edge of the door 14R by two screws 14SCR and edge screws 15SCR (FIG. 1).

The outside of metallic cabinet case 12 is stainless steel or galvanized steel, the metallic interior tank 18T is stainless steel or aluminum and the cabinet thermal breaker 22 and the door thermal breaker 30 are flexible polyvinyl chloride (PVC). The inside panel of the doors 14 are stainless steel or aluminum. The two-part thermal insulating foam 14I is open cell foam of two pound per cubic foot density made from isocynate and resin blown into a cavity simultaneously.

Bottom hinge 40BR (FIG. 2) consists of the fixed hinge 40BFR which is screwed by three screws (not shown) to the front panel 22F, and the rotating hinge 40BRR which has an internal section that is screwed to door 14R by three screws and then covered. The internal section of rotating hinge 40BRR has a downwardly extending stud (not shown) which is rotatingly mounted in a matching hole (not shown) in the fixed hinge 40BFR. Then the extending stud is fixed in the matching hole by a screw (not shown) which passes through a washer through the bottom of the rotating hinge 40BRR into the bottom end of the stud. Top hinge 40TR is constructed the same way.

The hinges 40BR and 40TR of cabinet door 14R (FIGS. 1 and 2) can be moved from one side of the door opening to the other to reverse the door opening direction. First the screw which connects the bottom of each door hinge stud to the bottom of each rotating hinge 40BRR and 40TRR is removed. Then the cabinet door 14R is lifted off the fixed hinges 40BFR and 40TFR. Then the three screws which connect each of the fixed hinges 40BFR and 40TFR to the front panel 12FL of the cabinet 12 are removed to remove the fixed hinges 40BFR and 40TFR. Then three decorative screws on the other side of the door opening where each of the fixed hinges 40BFR and 40TFR are to be moved are removed to provide the six fixed hinge mounting holes to mount the fixed hinges 40BFR and 40FTR on the new hinged side of the door opening. The six decorative screws are then screwed into the now empty six holes on the other side of the door opening. Then the rotating hinges 40BRR and 40TRR are removed from the door 14R, rotated 180° and remounted. Then door 14R is rotated 180° and its rotating hinges 40BRR and 40BRR are mounted in the fixed hinges 40BFR and 40TFR and the bottom screws inserted to connect each rotating hinge 40BRR and 40TRR to the fixed hinges 40BFR and 40TFR.

When the door 14R is reversed in opening direction the recessed door handle 26R, being the full length of the outside door edge, can easily be reached to open the door 14R.

Thus all of the objects and advantages of the invention and its features, as stated at the beginning of this specification, are accomplished.

It is understood that the construction shown and described herein is merely illustrative of the invention and its features and that the invention and its features may be embodied in other forms within the scope of the claims.

What is claimed is:

1. A refrigerator cabinet comprising:

(A) a cabinet case having a door opening in the front of said cabinet case;

(B) a metallic cabinet liner mounted on the inside of said cabinet case;

(C) thermal insulation separating said cabinet case and said metallic cabinet liner;

(D) a door hingedly connected to the front of said cabinet case and adapted to swing over said door opening;

(E) a plastic cabinet thermal breaker mounted between said cabinet case and said metallic cabinet liner and framing said door opening;

(F) a metallic breaker cap, separate from said cabinet case and said metallic cabinet liner, mounted on and covering substantially the entire outside of said plastic cabinet thermal breaker but not a front facing portion of said plastic cabinet thermal breaker;

(G) a plastic door thermal breaker mounted along the outer edge of the inside of said door;

(H) said plastic door thermal breaker having an outwardly extending compressible portion which is adapted to press against said front facing portion of said plastic cabinet thermal breaker when said door is closed.

2. The refrigerator cabinet of claim 1 wherein said metallic breaker cap has a front facing side and said outwardly extending compressible portion of said plastic door thermal breaker has a balloon section which is adapted to press against both said front facing side of said metallic breaker cap and said front facing portion of said plastic cabinet thermal breaker when said door is closed.

3. The refrigerator cabinet of claim 1 wherein said metallic breaker cap comprises a body substantially equal in width to the width of said plastic cabinet thermal breaker with a resilient finger section extending inwardly and substantially orthogonally from each side of said body, said resilient finger sections being adapted to removably snap on to said plastic cabinet thermal breaker.

4. The refrigerator cabinet of claim 1 wherein said cabinet case is metal and said plastic door thermal breaker has a plastic encased magnet adapted to magnetically close said door when in magnetic attraction range of the front of said metallic cabinet case.

5. The refrigerator cabinet of claim 1 wherein said plastic door thermal breaker has an angularly extending wiper in contact with the inside of said door.

6. The refrigerator cabinet of claim 1 wherein said door has a reduced outside portion along substantially its entire outer edge opposite the hinged side of said door, and a recessed door handle mounted in said reduced outside portion of said door along substantially the entire length of said door.

7. The refrigerator cabinet of claim 6 wherein said recessed handle has a mounting portion at each end each respectively attached to the top and bottom surface of said door.

8. The refrigerator cabinet of claim 1 wherein said plastic cabinet thermal breaker comprises:

(I) a base having outside and inside ends;

(J) a first outside finger portion orthogonally extending from said outside end of said base;

(K) a first inside finger portion orthogonally extending from said outside end of said base adjacent said first outside finger portion to form a groove adapted to be mounted over a panel edge of said cabinet case adjacent said door opening;

(L) a second outside finger portion orthogonally extending from said inside end of said base;

(M) a second inside finger portion orthogonally extending from said inside end of said base adjacent said second outside finger portion to form a groove adapted to be mounted over a panel edge of said metallic cabinet liner adjacent said door opening.

9. The refrigerator cabinet of claim 1 wherein said plastic door thermal breaker comprises:

(I) a base having front and back sides;

(J) a balloon portion extending from the front side of said base;

(K) a bellows portion extending from the front side of said base adjacent said balloon portion;

(L) a magnet retainer portion extending from said bellows portion;

(M) a magnet encompassed by said magnet retainer portion;

(N) and a door retainer portion extending from the back side of said base and adapted to be mounted in an opening in said door.

10. The refrigerator cabinet of claim 9 wherein said plastic door thermal breaker further comprises a wiper portion angularly extending from said balloon portion and adapted to press against the inside of said door.

11. A refrigerator cabinet comprising:

(A) a cabinet case having a door opening in the front of said cabinet case;

(B) a metallic cabinet liner mounted on the inside of said cabinet case;

(C) thermal insulation separating said cabinet case and said metallic cabinet liner;

(D) a door hingedly connected to the front of said cabinet case and adopted to swing over said door opening;

(E) a plastic cabinet thermal breaker mounted between said cabinet case and said metallic cabinet liner and framing said door opening; and (F) a metallic breaker cap, separate from said cabinet case and said metallic cabinet liner, mounted on and covering substantially the entire outside of said plastic cabinet thermal breaker.

12. The refrigerator cabinet of claim 11 wherein said door has a reduced outside portion along substantially its entire outer edge opposite the hinged side of said door, and a recessed handle mounted in said reduced outside portion of said door along substantially the entire outer edge of said door.

13. A refrigerator cabinet comprising:

(A) a cabinet case having a door opening in the front of said cabinet case;

(B) a metallic cabinet liner mounted on the inside of said cabinet case;

(C) thermal insulation separating said cabinet case and said metallic cabinet liner;

(D) a door hingedly connected to the front of said cabinet case and adopted to swing over said door opening;

(E) a plastic cabinet thermal breaker mounted between said cabinet case and said metallic cabinet liner and framing said door opening; and (F) a metallic breaker cap mounted on and covering substantially the entire outside of said plastic cabinet thermal breaker comprising a body substantially equal in width to the width of said plastic cabinet thermal breaker with a resilient finger section extending inwardly and substantially orthogonally from each side of said body;

(G) said resilient finger sections of said metallic breaker cap being adapted to removably snap on to said plastic cabinet thermal breaker.

14. A refrigerator cabinet comprising:

(A) a metallic cabinet case having a door opening in the front of said cabinet case;

(B) a metallic cabinet liner mounted on the inside of said cabinet case;

(C) thermal insulation separating said metallic cabinet case and said metallic cabinet liner;

(D) a door hingedly connected to the front of said metallic cabinet case and adopted to swing over said door opening;

(E) a plastic cabinet thermal breaker mounted between said metallic cabinet case and said metallic cabinet liner and framing said door opening, said plastic cabinet thermal breaker having a front facing portion;

(F) a metallic breaker cap, having inwardly and substantially orthogonally extending finger sections with one front facing, removably snapped on and covering substantially the entire outside of said plastic cabinet thermal breaker but not a first part of said front facing portion of said plastic cabinet thermal breaker, said front facing finger section of said metallic breaker cap covering another part of said front facing portion of said plastic cabinet thermal breaker;

(G) a plastic door thermal breaker mounted along the outer edge of the inside of said door;

(H) said plastic door thermal breaker having an outwardly extending compressible balloon portion which is adapted to press against both said first part of said front facing portion of said plastic cabinet thermal breaker and said front facing finger section of said metallic breaker cap when said door is closed; and (I) a plastic encased magnet in said plastic door thermal breaker adapted to magnetically close said door when in magnetic attraction range of the front of said metallic cabinet case.

15. The refrigerator cabinet of claim 14 wherein said plastic door thermal breaker has an angularly extending wiper in contact with the inside of said door 16. The refrigerator cabinet of claim 14 wherein said door has a reduced outside portion along substantially its entire outer edge opposite he hinged side of said door, and a recessed handle mounted in said reduced outside portion of said door along substantially the entire outer edge of said door.

17. A refrigerator cabinet comprising:

(A) a cabinet case having right and left door openings in the front of said cabinet case;

(B) a metallic cabinet liner mounted on the inside of said cabinet case;

(C) thermal insulation separating said cabinet case and said metallic cabinet liner;

(D) right and left doors hingedly connected to the front of said cabinet case and adopted to swing over said right and left door openings respectively;

(E) right and left plastic cabinet thermal breakers mounted between said cabinet case and said metallic cabinet liner and framing said right and left door openings respectively, each of said right and left plastic cabinet thermal breakers having a front facing portion;

(F) right and left metallic breaker caps mounted on and covering substantially the entire outsides of said right and left plastic cabinet thermal breakers respectively but not said right and left front facing portions of said right and left plastic cabinet thermal breakers, each of said right and left metallic breaker caps being separate from said cabinet case and said metallic cabinet liner;

(G) right and left plastic door thermal breakers mounted along the outer edges of the insides of said right and left doors respectively;

(H) each of said right and left plastic door thermal breakers having an outwardly extending compressible balloon portion which is adapted to press against said front facing portions of said right and left plastic cabinet thermal breakers respectively when said right and left doors are closed.

18. The refrigerator cabinet of claim 17 wherein each of said metallic breaker caps has a front facing portion, and said outwardly extending compressible balloon portion of each of said right and left plastic door thermal breakers is adapted also to press against said front facing portion of said right and left metallic breaker caps respectively.

19. A refrigerator cabinet comprising:

(A) a cabinet case having right and left door openings in the front of said cabinet case;

(B) a metallic cabinet liner mounted on the inside of said cabinet case;

(C) thermal insulation separating said cabinet case and said metallic cabinet liner;

(D) right and left doors hingedly connected to the front of said cabinet case and adopted to swing over said right and left door openings respectively;

(E) right and left plastic cabinet thermal breakers mounted between said cabinet case and said metallic cabinet liner and framing said right and left door openings respectively, each of said right and left plastic thermal breakers having a front facing portion;

(F) right and left metallic breaker caps mounted on and covering substantially the entire outsides of said right and left plastic cabinet thermal breakers respectively but not said right and left front facing portions of said right and left plastic cabinet thermal breakers, each of said metallic breaker caps comprising a body substantially equal in width to the width of said plastic cabinet thermal breaker with a resilient finger section extending inwardly and substantially orthogonally from each side of said body, with one of said resilient finger sections front facing;

(G) right and left plastic door thermal breakers mounted along the outer edges of the insides of said right and left doors respectively;

(H) each of said right and left plastic door thermal breakers having a balloon section which is adapted to press against said front facing portion of each of said right and left plastic cabinet thermal breakers respectively when said right and left doors are closed;

(I) said balloon sections of each of said outwardly extending compressible portions of said right and left plastic door thermal breakers being adapted also to press against said front facing resilient finger section of each of said right and left metallic breaker caps respectively;

(J) said resilient finger sections of each of said right and left metallic breaker caps being adapted to removably snap on to said right and left plastic cabinet thermal breakers respectively.

20. The refrigerator cabinet of claim 19 wherein said cabinet case is metal and each of said plastic door thermal breakers has a plastic encased magnet adapted to magnetically close said first and second doors respectively when in magnetic attraction range of the front of said metal cabinet case.

21. The refrigerator cabinet of claim 20 wherein each of said right and left plastic door thermal breakers has an angularly extending wiper in contact with the inside of said right and left doors respectively.

22. The refrigerator cabinet of claim 21 wherein each of said right and left doors has a reduced outside portion along substantially its entire edge opposite the hinged side of said door, and a recessed handle mounted in said reduced outside portion of said door along substantially its entire outer edge.

* * * * *